United States Patent [19]

Piteo

[11] 4,436,076

[45] Mar. 13, 1984

[54] ELECTRONIC SPEED CONTROL FOR CAPACITOR DISCHARGE IGNITION SYSTEM

[75] Inventor: Michael J. Piteo, Enfield, Conn.

[73] Assignee: R. E. Phelon Company, Inc., East Longmeadow, Mass.

[21] Appl. No.: 306,281

[22] Filed: Sep. 25, 1981

[51] Int. Cl.[3] ..... F02P 5/00

[52] U.S. Cl. ..... 123/602; 123/630; 123/198 DC; 123/334; 123/618

[58] Field of Search ..... 123/618, 630, 334, 335, 123/599, 602, 198 D, 198 DC

[56] References Cited

U.S. PATENT DOCUMENTS

| | | | |
|---|---|---|---|
| 3,490,426 | 1/1970 | Farr | 123/599 |
| 3,875,915 | 4/1975 | Anderson et al. | 123/335 |
| 3,967,604 | 7/1976 | Kondo | 123/335 |
| 4,038,951 | 8/1977 | Schweikart | 123/335 |
| 4,186,711 | 2/1980 | Joerg | 123/630 |
| 4,297,977 | 11/1981 | Boyama | 123/335 |

FOREIGN PATENT DOCUMENTS

| | | | |
|---|---|---|---|
| 1031410 | 5/1978 | Canada | 123/335 |
| 55-128666 | 10/1980 | Japan | 123/599 |

*Primary Examiner*—Parshotam S. Lall

*Attorney, Agent, or Firm*—Chapin, Neal & Dempsey

[57] ABSTRACT

Electronic shut-off circuit is provided in a capacitor discharge ignition system for internal combustion engines to protect against excessive high-speed operation. The circuit includes an electronic switching component connected across the main capacitor of the ignition system. A trigger coil is connected in circuit with a control electrode of the electronic switching component. The trigger coil is selected to generate a sufficient voltage to bias the switching means to its conductive state, thereby providing a low impedance shunt path to short the capacitor and to prevent it from discharging its energy into the primary of the ignition coil. A resistance-capacitance network, in circuit with the switching component, serves to hold it "on" until the engine is shut off.

5 Claims, 1 Drawing Figure

ELECTRONIC SPEED CONTROL FOR CAPACITOR DISCHARGE IGNITION SYSTEM

BACKGROUND OF THE INVENTION

Figure 1:
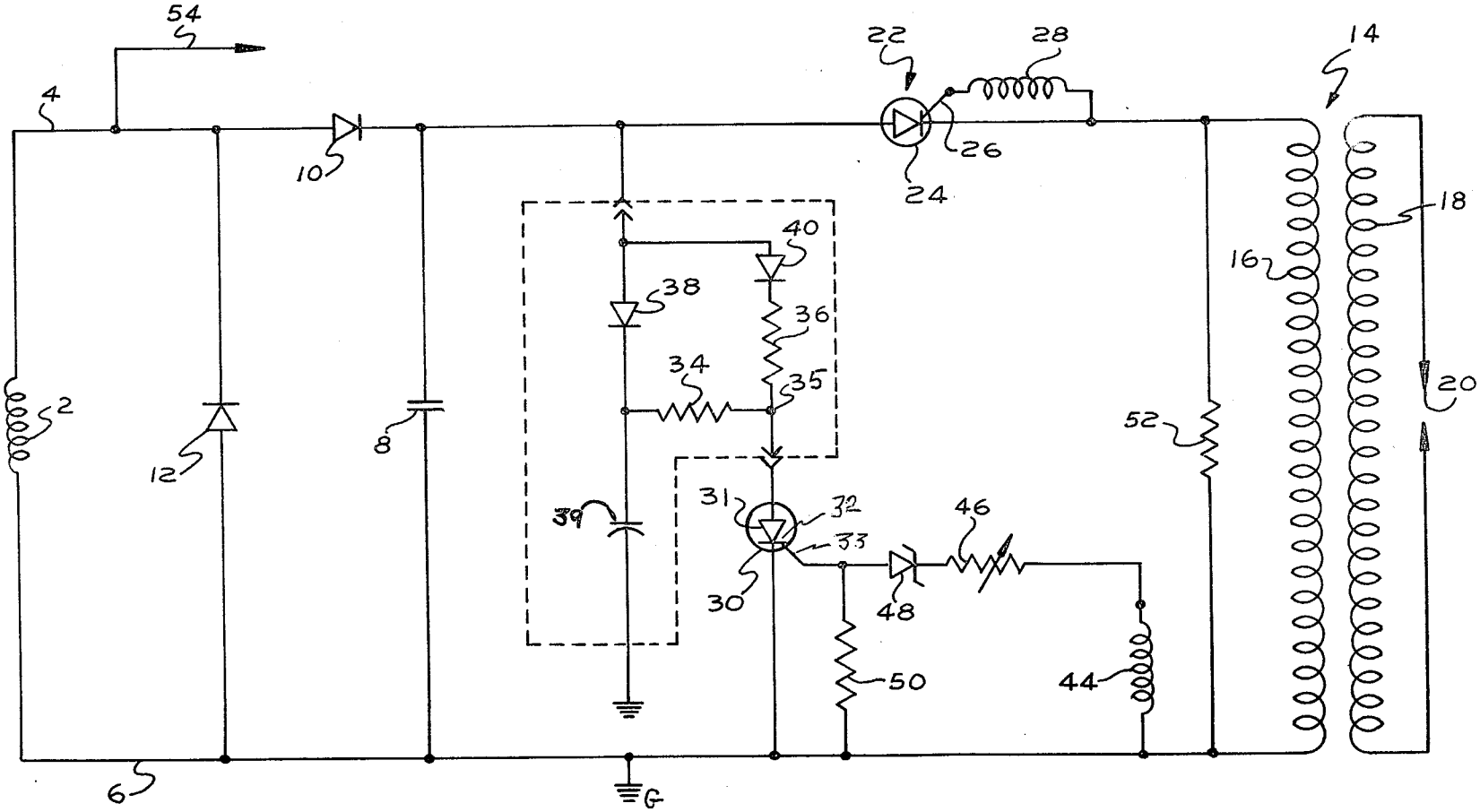

This invention relates to capacitor discharge (C/D) ignition systems for use with internal combustion engines. U.S. Pat. No 4,036,201 discloses one such capacitor discharge ignition system. More particularly, the invention relates to such C/D ignition systems as are used with small high-speed, single-cylinder engines of the type used for powering lawnmowers chain saws, portable water pumps and the like.

Certain types of engine applications, such as water pumps, are designed to be run without attendance of an operator. In order to protect the water pump from being damaged because of the lack of water flow through it, means is provided for automatically cutting off the engine in response to a predetermined engine rpm. Conventionally, such protection devices utilize an igniton cut-out switch actuated by a magneto pickup coil.

Since the small engine market is most competitive, the principal object of this invention is to provide a capacitor discharge ignition system equipped with a built-in, protective device which is economical and reliable to protect against damage caused by excessive engines speeds.

Another object of this invention is to provide a high-speed engine shut-off of the above type for C/D ignition systems such as when used in engines for water pump engine applications.

The above and other objects and advantages of the invention will be more readily apparent with reference to the accompanying drawings in which FIG. 1 is a schematic wiring diagram of a capacitor discharge ignition system of the type embodying this invention.

Referring in detail to the drawing, in FIG. 1 is shown the electronic portion of a capacitor discharge ignition system embodying this invention. The system comprises a charging coil 2 connected by conductive leads or wires 4 and 6 to a capacitor 8. Permanent magnets, not shown, are rotated relative to the charge coil which is disposed on a core lamination, as disclosed in U.S. Pat. No. 4,036,201. The magnet may be carried by the rim of the engine flywheel, as shown in the U.S. Pat. No.4,036,201 patent. A charging diode 10 is poled to pass pulses of positive polarity to charge the capacitor 8 and a shunting diode 12 is connected across the charging coil to shunt the negative half wave charge coil voltages to ground.

The leads 4 and 6 connect the main charging capacitor 8 to ignition coil 14 which comprises a primary winding 16 and secondary winding 18 connected to a spark gap device 20 of an internal combustion engine.

A first electronic switch means shown generally at 22, selectively discharges the electrical energy from capacitor 8 through the primary winding 16 of the ignition coil 14. As shown, this switch means comprises a silicon controlled rectifier or SCR 24, having a control electrode or gate 26 connected to a trigger coil 28. The trigger coil is disposed at a selected position relative to the top dead center position of the engine flywheel so that a trigger pulse is generated to turn "on" or trigger the SCR 24 to its low impedance mode. At that instant, the voltage stored in capacitor 8 is discharged through the primary 16 and a voltage is induced in the secondary

18 to provide an ignition pulse across spark plug 20. This sequence of charging and discharging the capacitor 8 repeats for each rotation of the magnets past the charging coil as disclosed in U.S. Pat. No. 4,036,201. The engine will continue to run so long as the ignition spark is provided to ignite a combustible mixture in the engine cylinder.

If for any reason the engine runs at excessively high rpm, there is a danger of damage to the engine and/or the driven apparatus. In accordance with this invention, the C/D ignition system is provided with an automatic shut-off device incorporated directly into the igntion circuit module. The shut-off device comprises an electronic switch or SCR 30 connected in a circuit across the main charge capacitor 8. The function of the electronic switch 30 is to shunt the current from the capacitor 8 and charge coil 2 so that no ignition pulse will be generated by the ignition coil 14.

As shown, the anode 31 of the SCR is connected to junction 33 in circuit with resistors 34 and 36, each in turn connected in a separate parallel circuit with a diode 38 and 40 respectively polarized to pass positive half-cycle voltages. A capacitor 39, connected across the anode/cathode electrode of the SCR 30, has a relatively large capacitance value, and is charged by positive half wave pulses through diode 38. The capacitor 39 is maintained in its charged condition by the blocking action of diodes 38 and 40. Capacitor 39 and resistor 34, which has a relatively large resistance compared to resistor 36 establishes a relatively long time constant to hold "on" SCR 30 whenever it becomes conductive, as will hereinafter be more fully described. Resistor 36 is a current-limiting resistor to protect the SCR 30 against excessively high current in its anode/cathode path when it is triggered "on".

The cathode 32 of the SCR is connected to ground potential G and its gate electrode 35 is in circuit with a second trigger coil 44 located so that voltage pulses will be generated therein by each passage of the flywheel magnets thereby. A calibrating resistor 46 and zener diode 48 serve to provide the trigger current level of the SCR 30. A resistor 50 is connected across the gate cathode electrodes of the SCR 30. The value of this resistor is selected to establish the operating point for the zener diode 48 and for desensitizing the SCR 30 so that it will not be triggered "on" by stray electrical pulses.

A resistor 52 is connected in parallel with the primary coil 16 to extend the time duration of ignition pulse generated by the ignition coil 14 and in units where the ignition coil has an external connection, the resistor 52 provides a discharge path for the main capacitor should the ignition coil be disconnected from the circuit with the capacitor in a charged condition. A kill switch 54 is also included to short out the charge coil and thereby manually stop the engine.

At normal operating speeds, the sinusoidal voltages generated in the charge coil 2 charge the main storage capacitor 8. At this time, SCR 24 and 30 are in their high impedance or non-conducting mode and one positive half cycles of the charge coil voltage pass through diode 10 to charge the capacitor 8. Simultaneously, current pulses also flow through diode 38 to secondary charge capacitor 39 which remains charged during normal operation because blocking diodes 38 and 40 prevent its discharge. As the magnet means rotate past the principal trigger coil 28, the SCR 24 is gated "on" and the energy stored on the capacitor 8 discharges through the primary coil 16 via the anode/cathode junction of the SCR 24. The resulting current flow through the primary coil 16 induces an ignition pulse in the secondary coil 18 and thereby creates an ignition spark across the spark plug 20.

In the event that the engine begins to run at excessively high rpm, such as when an unattended sump pump runs low on water, the shut-off circuit will operate. In such an event, the SCR 30 is gated on by a voltage of predetermined amplitude being generated in trigger coil 44. This allows anode gate current to flow, its level being established by the breakdown point of zener diode 48 and the resistance set on calibrating resistor 46 for a particular engine application.

When triggered "on", the SCR 30 will conduct heavily through its anode/cathode path and current from the charge coil 2 and capacitor 8 will thus be shunted to ground through diode 40, current-limiting resistor 36 and the SCR 30. It is important that the SCR remain "on" until the engine is completely "off", otherwise, it could cycle back and forth between high and low rpm.

To prevent such cycling, the capacitor 39, by discharging through resistor 34, provides a holding current to the SCR 30. In this connection the values of the resistor 34 and capacitor 39 are selected to provide a predetermined time constant whereby the SCR 30 will be held in its conducting mode for the full time necessary to achieve complete engine cut-off. In addition, the SCR 30 per se is selected to have a holding current level to achieve this result for a given engine.

Having thus described my invention, what is claimed is:

1. In a capacitor discharge ignition system for an internal combustion engine having rotatable magnet means associated with engine rotation to generate electrical energy, a capacitor chargeable by said energy and selectively connected in timed relationship with engine operation to the primary winding of an ignition coil to generate an ignition pulse by the discharge of the capacitor charge through said primary winding, as a means for protecting said engine and any apparatus driven thereby against excessive high-speed operation, an electronic shut-off system comprising a silicon controlled rectifier (SCR) having anode, cathode and gate electrodes, with its anode/cathode path connected in parallel with said capacitor and the primary winding of said ignition coil to shunt the energy from the charge coil and capacitor away from said primary winding, means for generating a voltage in response to a predetermined high rotational speed of said engine, the gate of said SCR being connected to said means for generating a voltage for triggering said SCR to its conductive state and means for maintaining the SCR in its conductive state for a predetermined time sufficient to ensure complete engine cut-off, including a second capacitor and a resistor connected to provide continuing current to said anode to hold the SCR "on" for said predetermined time.

2. In a capacitor discharge ignition system, an electronic shut-off in accordance with claim 1 in which said SCR includes a gate electrode, and a trigger coil is connected to said gate to trigger the SCR "on" in response to voltage generated in said trigger coil at high engine rpm.

3. In a capacitor discharge ignition system, an electronic shut-off in accordance with claim 2 in which the gate of said SCR is in circuit with said trigger coil and a zener diode.

4. In a capacitor discharge ignition system, an electronic shut-off as set forth in claim 3 in which a diode is provided to maintain said second capacitor charged until said SCR is rendered conductive.

5. In a capacitor discharge ignition system, an electronic shut-off as set forth in claim 4 in which said SCR is selected to have a predetermined holding current and said second capacitor and resistor provide a R/C network to provide said SCR with said holding current until said engine shuts off.

* * * * *